US008371222B2

(12) United States Patent
Kennedy et al.

(10) Patent No.: US 8,371,222 B2
(45) Date of Patent: Feb. 12, 2013

(54) LUMBER PRINTER

(75) Inventors: Russell Kennedy, Hot Springs, AR (US); Pat Conry, Hot Springs, AR (US); Chris Raybon, Hot Springs, AR (US); Douglas Tinsley, Hot Springs, AR (US)

(73) Assignee: Baxley Equipment Co., Hot Springs, AR (US)

( * ) Notice: Subject to any disclaimer, the term of this patent is extended or adjusted under 35 U.S.C. 154(b) by 324 days.

(21) Appl. No.: 12/888,485

(22) Filed: Sep. 23, 2010

(65) Prior Publication Data

US 2011/0072990 A1 Mar. 31, 2011

Related U.S. Application Data

(60) Provisional application No. 61/245,724, filed on Sep. 25, 2009.

(51) Int. Cl.
*B41L 3/02* (2006.01)
*B41F 17/00* (2006.01)

(52) U.S. Cl. ..... 101/486; 101/35; 101/36; 101/328

(58) Field of Classification Search ..... 101/35, 101/36, 37, 327, 328, 329, 483, 484, 485, 101/486

See application file for complete search history.

(56) References Cited

U.S. PATENT DOCUMENTS

| | | | | | |
|---|---|---|---|---|---|
| 2,778,296 | A | * | 1/1957 | De Koning | 101/5 |
| 3,140,656 | A | * | 7/1964 | Shook | 101/35 |
| 3,168,863 | A | * | 2/1965 | McRae | 101/43 |
| 3,175,485 | A | * | 3/1965 | Cunningham, Jr. | 101/35 |
| 4,392,204 | A | * | 7/1983 | Prim et al. | 700/227 |
| 4,627,349 | A | * | 12/1986 | Claussen | 101/348 |
| 4,852,029 | A | * | 7/1989 | Pope et al. | 702/41 |
| 5,775,397 | A | * | 7/1998 | Lippincott | 144/356 |

* cited by examiner

*Primary Examiner* — Ren Yan
(74) *Attorney, Agent, or Firm* — Jeffrey S. Melcher; Manelli Selter PLLC

(57) ABSTRACT

Provided is a printer for printing stamps on boards and a method of printing stamps on boards. The printer is capable of printing multiple types of stamps simultaneously on boards.

8 Claims, 4 Drawing Sheets

SPIB. No. 2 Prime
KD 19 HT 341

LUMBER PRINTER

This application claims priority to U.S. Provisional Application Ser. No. 61/245,724, filed 25 Sep. 2009, the complete disclosure of which is incorporated herein by reference.

FIELD OF THE INVENTION

The invention relates to printers and methods of applying stamps to boards.

BACKGROUND OF THE INVENTION

The production of lumber involves the application of a stamp on a planed board that will remain with the board until it reaches the end user. These stamps primarily show the grade and sometimes other attributes of each piece of lumber. There are various sanctioning organizations that insure the quality and integrity of the various grades of lumber produced. These sanctioning organization control the issuing of stamps and their use. In addition to grade identification, stamps can be used to identify moisture content and heat treatment (for pest pasteurization) which is generally required on exported products.

For example, with southern yellow pine (SYP), most of the stamps are controlled or governed by SPIB http:www.spib.org/, which is an organization that sets and inspects the rules for each lumber grade. The stamp typically includes the grade mark, which identifies the grade of the board, and an identification indicating the SPIB "member" that manufactured the lumber. Generally, the board is only stamped in one location. However, recent market changes have required additional stamp locations along the lengthwise face of the board.

HT (heat treated for pest pasteurization) stamps usually are required to be applied to any wood packaging materials of any length being exported. Many manufacturers export two foot blocks that have been trimmed from the longer lengths of lumber to remove defects. Each two foot block must be marked with the HT stamp. The HT stamp cannot have a grade. The HT must state KD 19 HT. The U.S. Department of Agriculture Animal & Plant Health Inspection Service (APHIS) has entered into a Memorandum of Understanding with the Southern Pine Inspection Bureau (SPIB). The overall direction and control of the cooperative program is to be maintained by APHIS. The program provides the necessary documentation that kiln dried southern pine lumber exported to foreign countries has reached a critical temperature at the core to eradicate the "Pinewood Nematode" and its vectors (56° C./133° F. for 30 minutes). The HT mark is not limited to yellow pine, and is also used for other lumber types.

Mechanical printers, generally known as "grade printers," have been widely used in planer mill applications many years, stamping the grade on each individual piece of lumber using rubber stamps. The rubber stamps are typically located on rotating wheels with only one stamp being located on each wheel. The appropriate arm is lowered with a cylinder when the corresponding piece of lumber transverses beneath the rotating wheel. The wheel must travel the same lineal speed as the lumber to avoid smearing the stamp on the lumber. Presently, the wheels are driven by roller chains from the head shaft of the lugged conveyor that the boards are traversing on, i.e. the wheels are mechanically timed with the conveyor by the chains.

The lumber is generally transported on lugs, with one board per lug, transversely through a mill. Grade printers are located downstream of a board trimmer to apply a stamp to each board. For example, a lumber grader might call for grade

#2-8' on a near end of a board and grade #3-10' on a far end of the board. When this happens, the trimmer will cut an eighteen foot board in two pieces at approximately an eight foot position. As these two pieces come out of the trimmer, the far end piece will be picked up and "jumped" into the empty lug behind it. Once these different grade boards are on different lugs, they can be stamped with the appropriate gradestamps.

In addition, the stamps must also be timed to land, preferably centered, on the width of the board. Thus, for different width boards, such as 4, 6, 8, 10 and 12 inch boards, the stamp might not be located in the same position on a 4 inch wide board as on a 12 inch wide board. The timing is generally done mechanically, either with adjustable sprocket assemblies or an on-the-fly mechanical adjustment requiring a series of sprockets in a cross-shaped pattern.

Many mills desire to stock longer package lengths, such as 16, 18 and 20 foot lengths, with the ability to cut the finished package into two shorter lengths. If this is done, each end of the board must contain the same grade stamp so that when they are cut in two smaller sections, each piece will include the required grade stamp. When stamps, including the grade are required on each end of the board, the conventional grade printer must span across the conveyor and similar grade stamping arms must be placed on the far end of the board.

HT stamps must be placed every two feet or less on the board upstream of the trimmer to mark two foot cut-offs prior to trimming. Thus, when the stamp must include HT, two printers are required, the HT printer upstream of the trimmer and the grade printer downstream of the trimmer. Since the two foot blocks are normally dropped out to a turntable to be hand stacked, the HT stamp can be applied in the block conveyor or manually by the turntable operator.

The printers are mechanically driven via roller chain drives from the main drive. Chain slack and surge cause numerous maintenance problems and increase costs. There is generally insufficient room on present printers to include 6-8 grades on each end of a board and HT marks on 2 foot centers without interfering with the lugged chains that transport the lumber on 2 foot centers.

In view of the many shortcomings of present lumber printers, there is a great need for a printer that is capable of cost effectively applying stamps having different grades and other information, such as HT, manufacturer and dryness to lumber in one efficient step.

SUMMARY OF THE INVENTION

An objective is to provide an improved printer that is capable of cost effectively applying stamps having different grades and other information, such as HT, manufacturer and dryness to lumber in one efficient step.

Another objective is to provide an improved printer which is capable of apply a stamp having a first grade on one end of a board and a second stamp having a second grade at the other end of the board in one step.

The above objectives and other objectives are obtained by a printer comprising:

- a support constructed and arranged such that a length of the support can mount over a width of a conveyor for conveying boards transversely to be stamped;
- a drive shaft rotatably mounted to the support, the drive shaft disposed generally in the direction of the length of the support;
- a plurality of arms movably connected to the drive shaft;
- at least one lift mechanism constructed and arranged for lifting and lowering at least one arm;

at least one wheel rotatably mounted to at least one arm, the wheel having a plurality of stamps located around an outer surface of the wheel, and the wheel rotatably driven by rotation of the shaft;

a drive mechanism constructed and arranged for rotating the drive shaft;

a wheel position device constructed and arranged for determining a location of the stamps on the wheel; and an ink supply mechanism constructed and arranged for applying ink to the stamps.

The above objectives and other objectives are also obtained by a method of stamping boards using a printer comprising:

a support constructed and arranged such that a length of the support mounts over a width of a conveyor for conveying boards transversely to be stamped;

a drive shaft rotatably mounted to the support, the drive shaft disposed in generally the direction of the length of the support;

a plurality of arms movably connected to the drive shaft;

a plurality of lift mechanisms constructed and arranged for lifting and lowering the arms;

a plurality of wheels rotatably mounted to the arms, the wheels having a plurality of stamps located around an outer surface of the wheels, and the wheels rotatably driven by rotation of the shaft;

a drive mechanism constructed and arranged for rotating the drive shaft;

a wheel position device constructed and arranged for determining a location of the stamps on the wheels; and an ink supply mechanism constructed and arranged for applying ink to the stamps, the method comprising:

conveying a board on a conveyor under the printer so that the length of the board is substantially aligned with a length of the printer;

determining a desired stamp to be applied to the board;

rotating the shaft to rotate the wheels to a starting location for applying the desired stamp;

dropping the wheels down onto the board being conveyed for a time period sufficient for the wheels to rotate and apply the desired stamp to the board; and lifting the wheels off of the board when the desired stamp is applied to the board and before an undesired stamp is applied.

The objectives and other objectives are further obtained by a planer mill comprising:

a conveyor constructed and arranged for conveying boards transversely;

a board positioning device constructed and arranged for determining a location of a board being conveyed on the conveyor;

a trimmer in communication with the conveyor constructed and arranged for cutting boards into desired lengths; and a printer constructed and arranged for printing stamps on boards being conveyed on the conveyor, the printer comprising:

a support constructed and arranged such that a length of the support is mounted over a width of the conveyor;

a drive shaft rotatably mounted to the support, the drive shaft disposed in generally the direction of the length of the support;

a plurality of arms movably connected to the drive shaft;

at least one lift mechanism constructed and arranged for lifting and lowering at least one arm;

at least one wheel rotatably mounted to at least one arm, the wheel having a plurality of stamps located around an outer surface of the wheel, and the wheel rotatably driven by rotation of the shaft;

a drive mechanism constructed and arranged for rotating the drive shaft;

a wheel position device constructed and arranged for determining a location of the stamps on the wheel; and an ink supply mechanism constructed and arranged for applying ink to the stamps.

DETAILED DESCRIPTION

Figure 1:
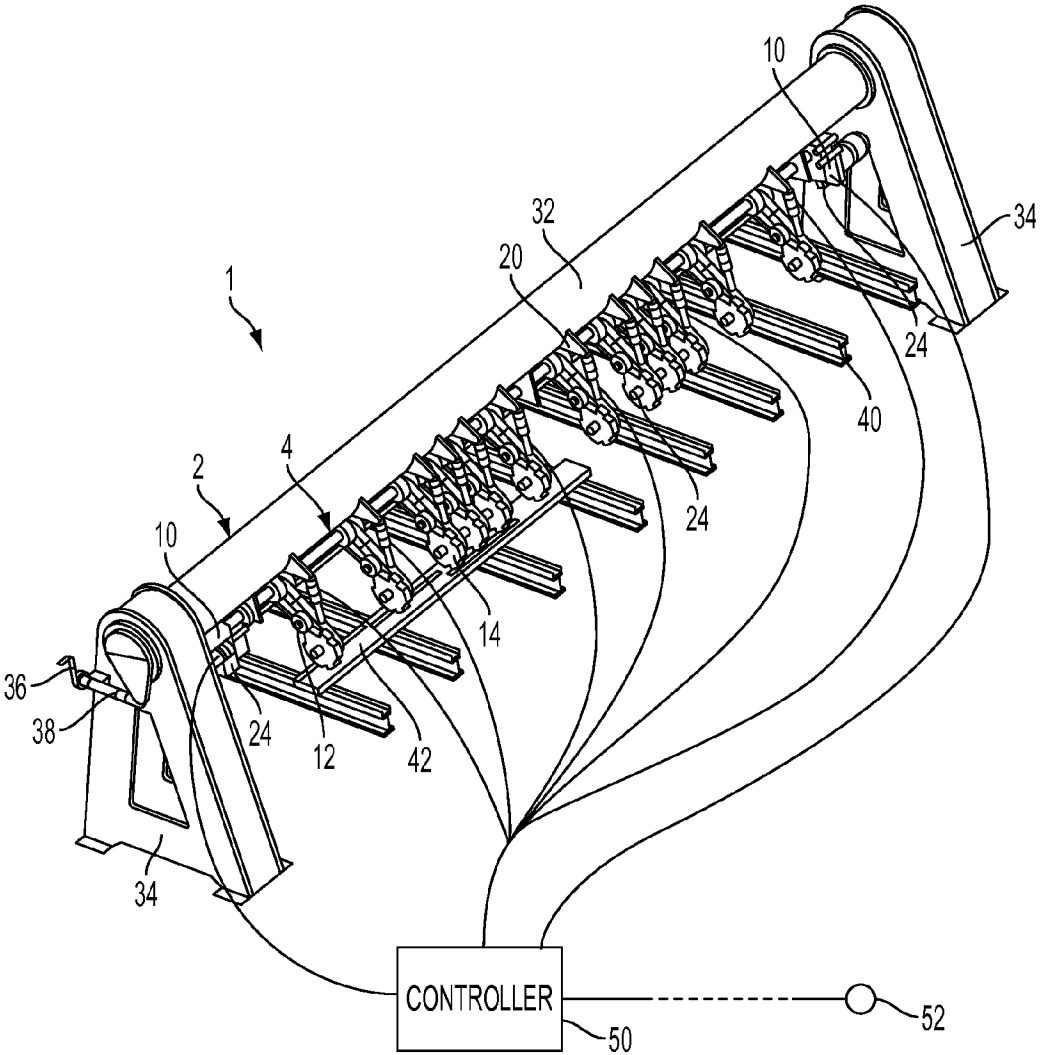
FIG. 1 illustrates a view of a lumber printer.
Figure 2:
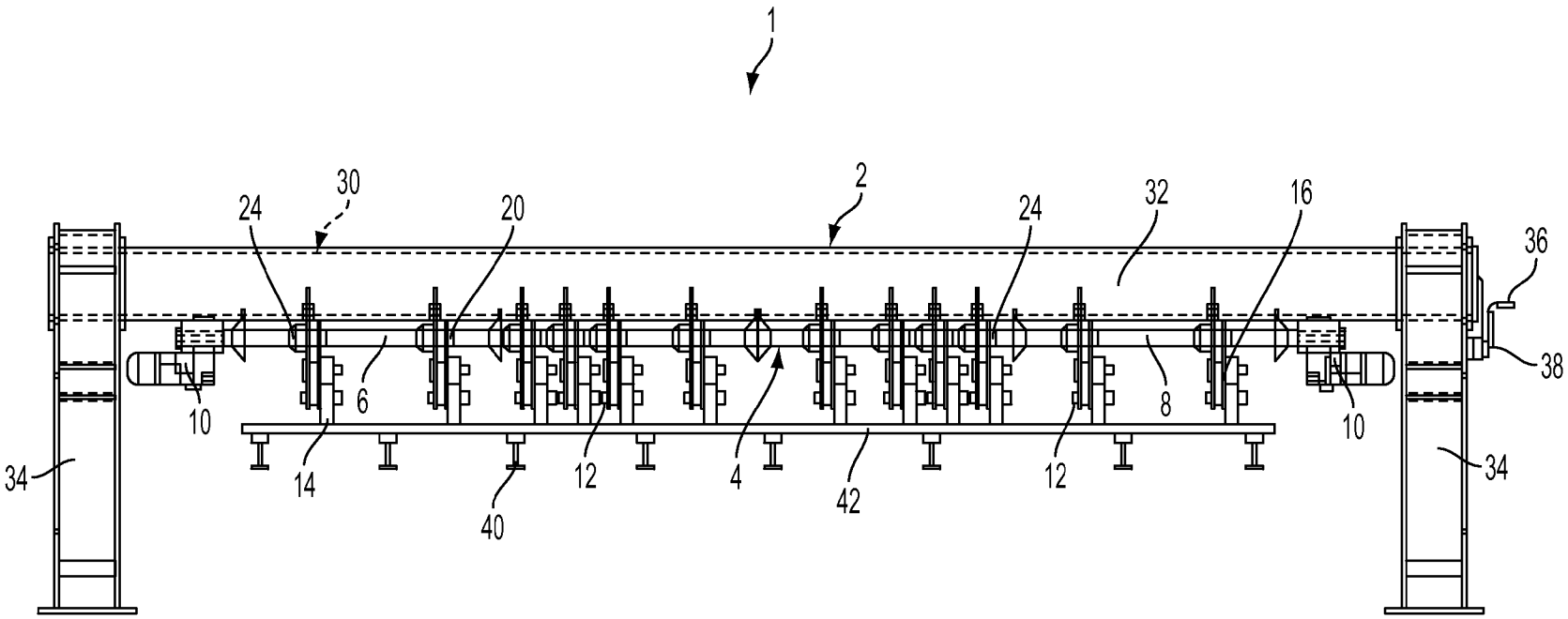
FIG. 2 illustrates a view of a lumber printer.
Figure 3:
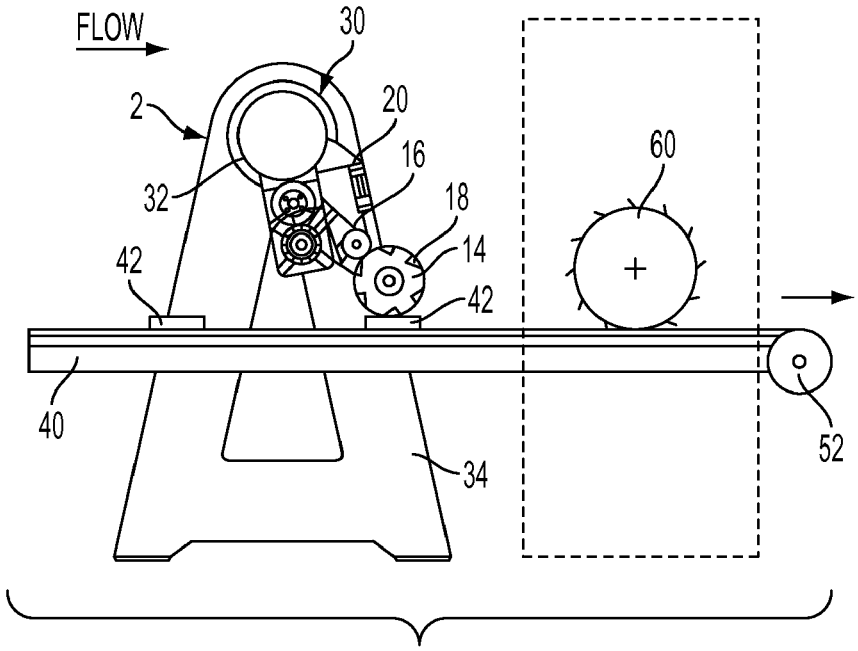
FIG. 3 illustrates a view of a lumber printer.
Figure 4:
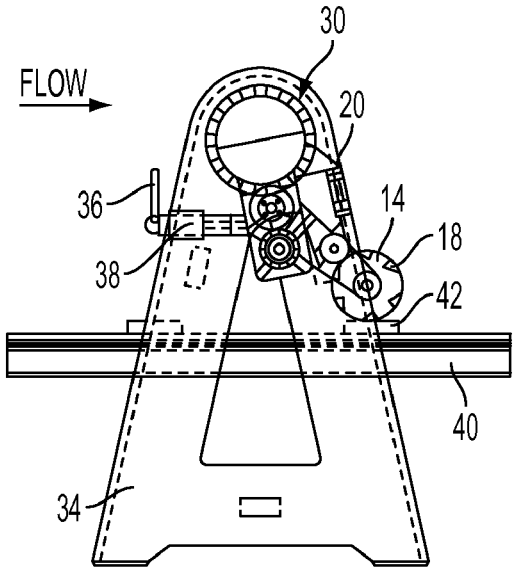
FIG. 4 illustrates a view of a lumber printer.

The invention will now be explained with reference to the attached FIGS. 1-6. FIGS. 1-5 illustrate a lumber printer 1 having a support 2. The support is sized to be mounted over the width of a conveyor 40 conveying lumber in the form of boards 42 transversely. Thus, for conveyors 40 conveying boards 42 having a length of up to 24 feet, the length of the support 2 must be greater than 24 feet.

A drive shaft 4 is rotatably mounted to the support 2 generally in the direction of the length of the support 2. Preferably, the shaft 4 is split into two sections, shaft section 6 and shaft section 8, that can rotate independently of each other. The shaft 4 is rotated by a drive mechanism 10, such as an electric motor. Alternatively, drive mechanism 10 can be any suitable mechanism, such as hydraulic. If the shaft 4 is split into two sections, each shaft section 6 and shaft section 8 should have an associated drive mechanism 10 so that the shafts sections 6 and 8 can be rotated independently of one another. Referring to the shaft 4 below also includes the shafts 6 and 8 unless otherwise stated.

Figures 5, 6:
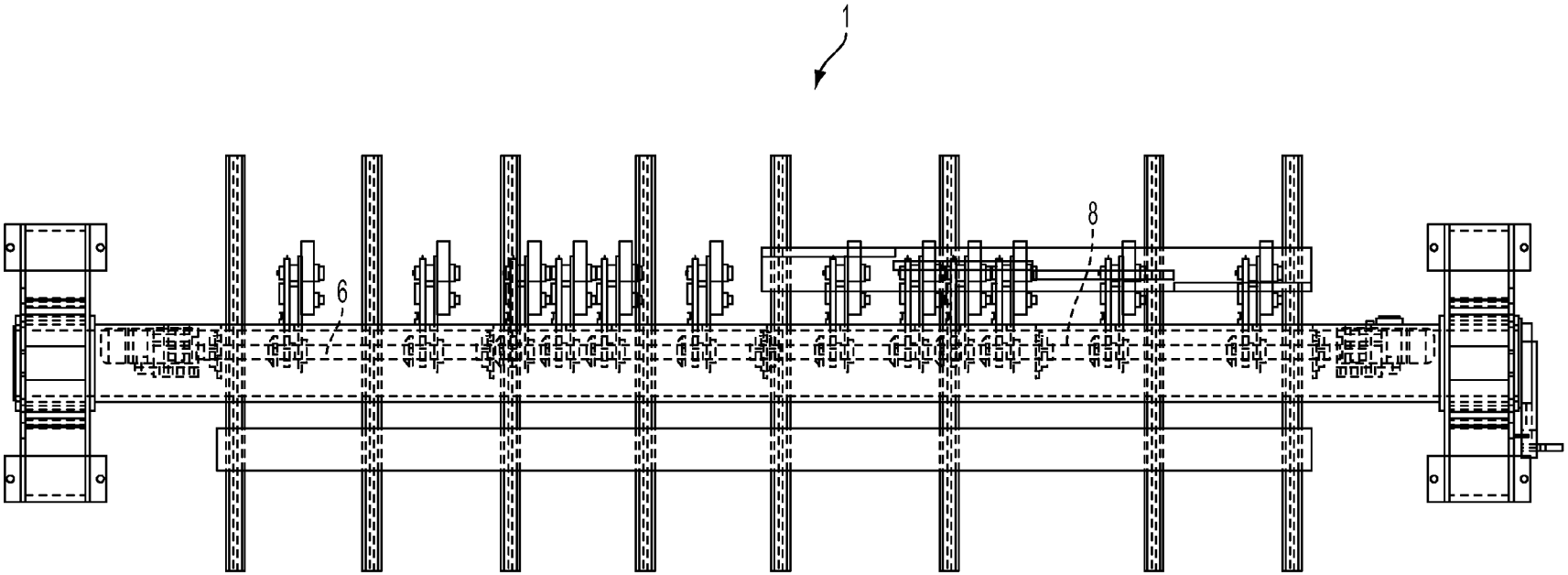
FIG. 5 illustrates a view of a lumber printer.
FIG. 6 illustrates a sample stamp.

A plurality of arms 12 are movably mounted to the shaft 4. Each arm 12 has at least one wheel 14 rotatably mounted on the arm 12. The wheel 14 is rotated by the shaft 4, such as by a roller chain 16 or other suitable drive, such as belts or gears. The wheel 14 has at least one stamp 18, preferably at least two stamps 18, and most preferably at least three stamps 18 located on an outer surface of the wheel 14. The stamps 18 can include any desired information, such as lumber grade, moisture content, heat treatment, manufacturer identification or any other information pertinent to that board. An example of a heat treatment stamp is shown in FIG. 6.

The arms 12 are lifted up and down in relation to the conveyor 40 by a lift mechanism 20. The lift mechanism 20 is preferably a pneumatic cylinder. Other suitable lift mechanisms include hydraulic, solenoid, or electric motor. Preferably, each arm 12 has an associated lift mechanism 20 so that they can be raised and lowed independently of one another.

The printer 1 includes a wheel position device. An example of the wheel position device is an encoder 24 associated with the shaft 4 for determining the position of the stamps 18 on the wheel 24. If there are two shafts sections 6 and 8, each shaft should have an associated encoder 24. The position of the wheels 14 are mechanically timed to the shaft 4, or shaft sections 6 and 8, so that if the position of the shaft 4 is known then the position of the stamps 18 on the wheels 14 are known. While not preferred, alternatively, encoders can be placed on each wheel 14. While not preferred, other means in place of encoders can be utilized if desired, such as switches or photocells.

The support 2 preferably also includes a support lift 30 that raises or lowers the height of the shaft 4 in relation to the conveyor 40, which in turn raises and lowers the arms 12 and wheels 14 as a unit. Thus, the initial position of all of the wheels 14 can be set using the support lift 30, and then the individual wheels 14 can be separately raised and lowered using the lift mechanisms 20. An example of the support lift 30 is a pipe 32 rotatably mounted to the side supports 34, a side arm 36 and a lock 38. By moving the arm 36, the pipe 32 rotates, which either lifts or lowers the arms 12 and the position of the pipe 32 can be secured using the lock 38. Any suitable support lift 30 can be used, such as hydraulic, electric or mechanical, which is capable of lifting and lower the shaft 4 in relation to the conveyor 40.

The conveyor 40 has an associated board positioning device 52 that determines the location of a board 42 being conveyed on the conveyor 40. The board position device 52 can be an encoder 52 that determines the shaft position and resulting lug and board position on the conveyor 40 that provides input to the controller 50 as to the location of a board 42 on the conveyor 40. While not preferred, other means in place of encoders can be utilized if desired, such as switches or photocells.

It is important that the printer 1 remains in time with the conveyor 40 and boards 42 to prevent catastrophic mislabeling. If boards are mislabeled, the entire finished lumber inventory at the mill may have to be re-graded. Since the timing between the printer 1 and the boards 42 is electronic, not mechanically via a roller chain drive as in conventional printers, the printer 1 may become out of phase with the boards 42 without the operator being aware of the mismatch, causing catastrophic results of placing incorrect stamps 18 or no stamps on the boards 42. Thus, preferably the controller 50 includes an alert feature if the printer 1 is out of phase with the boards 42. For example, the controller 50 can monitor the encoders 24 on shafts sections 6 and 8 and encoder 52. The encoders 24 and 52 could be determined to be "out of phase" by a pre-set (changeable) amount either "angular" or encoder counts. At the time the stamp 18 reaches the stamping position, the location of the encoders 24 and 52 can be compared by the controller 50. If the stamp 18 is out of phase by an amount over the allowance, the conveyor 40 can be shut off and an alarm displayed, such as "Printer out of Phase". The operator would have to push a reset button prior to conveyor 40 being able to start up again. There would also be a small j-box or console mounted on the end frame of the printer 1 with three buttons; ADVANCE TIMING, RETARD TIMING and SET TIMING. As the printer 1 and conveyor 40 are operating, the operator could hold down either button to appropriately center the stamp 18 position on the board width being run. The controller would "remember" encoder placements for differing board widths so that when they changed over from 4, 6, 8, 10 or 12 inch widths, the printer 1 would automatically be in phase with the boards 42. If after adjusting timing, the operator wanted the controller 50 to retain that information, he could push the SET TIMING pushbutton.

Preferably, the conveyor 40 or printer 1 includes a "board present" sensor, such as a photocell, located on the conveyor beneath the grade printer so that the controller 50 can measure the width of the board 42 through encoder 52, and know the location of the board 52 with respect to the grade printer 1, to automatically center the grade stamp 18 on the surface of the board 42.

A controller 50 is in communication with the lift mechanisms 20, drive mechanisms 10, encoders 24, and encoder 52. Once the desired stamps are determined for the particular board 42, the desired wheels 14 are rotated to the starting position of the desired stamps 18. When the board 42 passes under the printer 1, the lift mechanisms 20 drop the desired arms 12 down so that the desired wheels 14 contact the board 42 and wheels 14 rotate as the board 42 moves under the printer 1 to apply the desired stamps 18 to a width of the board 42. When the desired stamps 18 are completely applied to the board 42, the lift mechanisms 20 lift the arms 12 so that the wheels 14 are no longer in contact with the board 42 and undesired stamps 18 are not applied to the board 42. Examples of suitable controllers include an Allen Bradley or other brand PLC (programmable Logic Controller).

The wheels 18 should be aligned with the shaft 4 so that all similar stamps 18 are aligned in the same position. In this manner, when the wheels 14 are lowered onto the board 42, conflicting stamp information is not applied to the board 42. For example, for grade, all stamps 18 having the desired grade to be applied are aligned so that when the wheel 18 are lowered onto the board 42, the same grade is stamped on the board 42 in numerous positions along the length of the board 42. If the desired split shaft 4 configuration is utilized, shaft section 6 and shaft section 8, one portion of the board 42 can have a first grade stamped thereon and a second portion of the board 42 can have a second grade stamped thereon. Usually, the shaft 4 is split in the center to provide two equal length shaft sections 6 and 8. However, any length of shaft sections 6 and 8 can be used, and even more sections can be formed by further splitting the shaft 4. Thus, the desired stamps 18 can be aligned with the first shaft section 6 and the desired stamps 18 can be aligned with the second shaft section 8 to provide a first lumber grade or other stamp on a first section of the board 42 and a second lumber grade or other stamp on a second portion of the board 42. The wheels 14 can have different stamps. For example, a group of wheels 14 can have stamps 18 containing grades and a second group of wheels 14 can include stamps 18 having heat treatment information. If the heat treatment is to be stamped on the board 42, the wheels 14 should be no more than two feet apart the entire length of the board 42 to comply with current rules requiring a heat treatment stamp within every two feet along the length of the board 42. FIG. 5 illustrates a setup in which the wheels 14 having HT stamps 18 are no more than two feet apart and stamp 18 having grades 1-3 or 4-6 are present in both sections of the shaft sections 6 and 8. In this manner, both the desired HT and grade can be stamped on a board 42 simultaneously.

The improved printer described herein as the advantage that it can be placed upstream of a trimmer 60, and is highly flexible. Multiple different stamps 18 can be simultaneously applied in any desired location along the length of the board 42 before the board 42 is trimmed to desired lengths using the trimmer 60.

Planer mills having conveyors 40 for conveying boards 42 transversely, board positioning devices 52, and trimmers 60 are now well known. Any desired conveyor 40, board positioning device 52, and trimmer 60 can be used in combination with the novel printer described herein to practice the claimed invention.

While the claimed invention has been described in detail and with reference to specific embodiments thereof, it will be apparent to one of ordinary skill in the art that various changes and modifications can be made to the claimed invention without departing from the spirit and scope thereof.

We claim:

1. A method of stamping boards using a printer comprising:

a support constructed and arranged such that a length of the support mounts over a width of a conveyor for conveying boards transversely to be stamped;

a drive shaft rotatably mounted to the support, the drive shaft disposed in generally the direction of the length of the support;

a plurality of arms movably connected to the drive shaft;

a plurality of lift mechanisms constructed and arranged for lifting and lowering the arms;

a plurality of wheels rotatably mounted to the arms, the wheels having a plurality of stamps located around an outer surface of the wheels, and the wheels rotatably driven by rotation of the shaft;

a drive mechanism constructed and arranged for rotating the drive shaft;

a wheel position device constructed and arranged for determining a location of the stamps on the wheels; and an ink supply mechanism constructed and arranged for applying ink to the stamps, the method comprising:

conveying a board on a conveyor under the printer so that the length of the board is substantially aligned with a length of the printer;

determining a desired stamp to be applied to the board;

rotating the shaft to rotate the wheels to a starting location for applying the desired stamp;

dropping the wheels down onto the board being conveyed for a time period sufficient for the wheels to rotate and apply the desired stamp to the board; and lifting the wheels off of the board when the desired stamp is applied to the board and before an undesired stamp is applied.

2. A method according to claim 1, wherein the printer further comprises a second shaft and a second motor associated with the second shaft, the first and second shafts being disposed in generally the direction of the length of the support with the first shaft being disposed on a first portion of the support and the second shaft being disposed on a second portion of the support, and a plurality of first wheels associated with the first shaft and a plurality of second wheels associated with the second shaft, and the method further comprises determining a desired first stamp to be applied to a first section of the board and determining a desired second stamp to be applied to a second section of the board, rotating the first shaft to rotate the first plurality of wheels to a starting location for applying the first stamp and rotating the second shaft to rotate the second plurality of wheels to a starting location for applying the second stamp, dropping the first and second wheels down onto the board being conveyed using the lifting means to apply the first and second desired stamps onto the board, and lifting the first and second wheels of off the board when the first and second stamps are applied to the board and before an undesired stamp is applied, wherein the first and second stamps applied to the board are different.

3. A method according to claim 2, further comprising determining a phase between the printer and a position of the board and if the board is out of phase with the printer stopping the conveyor.

4. A method according to claim 1, wherein the wheels are no more than 2 feet apart so that a stamp is applied to the board every two feet or less along the length of the board.

5. A method according to claim 1, further comprising applying at least a first stamp containing a lumber grade to the board and applying at least a second stamp to the board containing a heat treatment, wherein the first and second stamps are applied simultaneously from different wheels.

6. A method according to claim 1, wherein the printer further comprises a support lift mechanism, and the method further comprises raising or lowering the shaft, arms and wheels as a unit.

7. A method according to claim 1, wherein the stamps comprise at least one of grade, moisture content, heat treatment, or manufacturer identification.

8. A method according to claim 1, wherein the stamp includes heat treatment and the stamp is applied to the board before the board is conveyed to a trimmer.

* * * * *